United States Patent [19]

Dry

[11] Patent Number: 4,796,515

[45] Date of Patent: Jan. 10, 1989

[54] RODLESS CYLINDER

[75] Inventor: Alan G. Dry, Brantford, Canada

[73] Assignee: Ascolectric Limited, Brantford, Canada

[21] Appl. No.: 2,740

[22] Filed: Jan. 12, 1987

[30] Foreign Application Priority Data

Sep. 5, 1986 [CA] Canada ..... 517623

[51] Int. Cl.[4] ..... F01B 9/00; F15B 15/22

[52] U.S. Cl. ..... 92/137; 91/395; 91/406

[58] Field of Search ..... 92/137; 91/25, 395, 91/405, 406

[56] References Cited

U.S. PATENT DOCUMENTS

| | | | |
|---|---|---|---|
| 1,799,366 | 4/1931 | Heinkel | 91/395 X |
| 2,103,252 | 12/1937 | Gartin | 92/137 X |
| 2,130,982 | 9/1938 | Gartin | 92/137 X |
| 2,535,899 | 12/1950 | Carlson | 92/137 X |
| 2,556,698 | 6/1951 | Loewe | 91/395 X |
| 3,136,225 | 6/1964 | Rader | 91/395 |
| 3,157,095 | 11/1964 | Heiser | 91/395 X |
| 3,173,337 | 3/1965 | Cunningham | 91/395 X |
| 3,559,771 | 2/1971 | Crane | 188/71.8 |
| 3,667,552 | 6/1972 | Gordon | 92/137 X |
| 3,745,888 | 7/1973 | Boretti | 92/137 X |
| 3,820,446 | 6/1974 | Granboom et al. | 92/88 |
| 3,885,654 | 5/1975 | Hauswirth | 91/395 X |
| 4,057,257 | 11/1977 | Berg | 92/137 X |
| 4,121,840 | 10/1978 | Berg | 92/137 X |
| 4,139,182 | 2/1979 | Nagase et al. | 91/395 X |
| 4,364,303 | 12/1982 | Sumida | 92/137 X |
| 4,373,427 | 2/1983 | Garlapaty et al. | 92/88 |
| 4,472,981 | 9/1984 | Peter | 92/137 X |

FOREIGN PATENT DOCUMENTS

| | | | |
|---|---|---|---|
| 2404244 | 8/1975 | Fed. Rep. of Germany | 92/137 |

*Primary Examiner*—John Rivell

*Attorney, Agent, or Firm*—Hubbard, Thurman, Turner & Tucker

[57] ABSTRACT

A rodless cylinder consisting of a cylinder, a piston within the cylinder for reciprocal movement therein, a guide along the outside of the cylinder, a drive block mechanism constrained to move along the guide, a pulley at each end of the cylinder and guide, a cable extending from each end of the cylinder, around a respective pulley and secured to a respective end of the drive block mechanism, a compressible resilient member extending from each end of the piston and, a sealing member co-operable with a valve seat located within an exit from each end of the cylinder, such that when the piston approaches one end of the cylinder, the resilient member forces the sealing member into sealing contact with the valve seat so preventing egress of fluid from one end of the piston to the outside of the respective end of the cylinder. The pulleys, cables and cylinder are also completely enclosed so that only the top of the drive block is exposed to the outside environment.

15 Claims, 4 Drawing Sheets

RODLESS CYLINDER

FIELD OF THE INVENTION

This invention relates to a fluid operated piston and cylinder arrangement which does not utilize a piston rod. These arrangements are known in the art as rodless cylinders.

BACKGROUND OF THE INVENTION

Rodless cylinders of the prior art comprise an elongated cylinder member containing a piston which is movable within the cylinder from one end to the other. This movement is responsive to the introduction of pressurized fluid into the cylindrical member. A flexible cable is secured to each end of the piston, each cable passing through seals in the ends of the cylinders and around a pulley at each end of the cylinder with the outer ends of the cables being secured to opposite sides of a drive block. U.S. Pat. No. 4,057,257 which issued on Nov. 8, 1977 to Tol-O-Matic Inc. is representative of this type of prior art. Various types of guides are utilized for supporting the reciprocating drive block, these either resting upon the outer wall of the cylinder or being separate guides supported away from the cylinder.

The cables which transfer the motion from the piston to the drive block must be kept under a slight tension so that during use the mechanism operates precisely with no slack occurring in either of the cables. The operation of a rodless cylinder is very rapid and there is little cushioning effect at the ends of the stroke with the result being that excessively large forces have to be contended with after the rapid acceleration of the cylinder from a stationary position. Large tension loads in the cables are therefore encountered which stretch the cables during use. The effects of such stretching cannot be tolerated and therefore an adjustment mechanism is required so that the cables can be periodically tensioned.

Also, rodless cylinders are often located in a dirty environment which leads to premature wear of the guides which support the reciprocating drive block and also of the cables and pulleys.

SUMMARY OF THE INVENTION

The rodless cylinder of this invention consists of a guide support for the reciprocating drive block and, a cylinder beneath the guide support, the cylinder including a piston having a cable from each end which passes through a seal at each end of the cylinder, around a pulley and to each respective end of a drive block. The drive block is preferably supported and guided upon the guide support by rollers secured to the drive block. Each end of the cylinder is provided with an axially extending compressible support means which has a disk valve which closes the exit from the cylinder when the piston is a set distance from the end of the cylinder. The remaining travel of the cylinder therefore compresses fluid in the cylinder and provides smooth retardation of the piston. Preferably a relief valve is utilized at both ends of the cylinder so that the degree of cushioning effect upon the piston can be limited.

The shock forces in the cables are therefore substantially reduced so that, after the cables have been pretensioned, only occasional readjustment is required to keep the cables under acceptable working tension.

The rodless cylinder is enclosed on both sides and the ends preferably by sheet or cast metal or plastic, and a wide groove is left along most of the length of the upper surface. Each side of this groove has a slotted guide and a flat belt is secured to the drive block and passes in both longitudinal directions through the slotted guide, around each pulley and below the cylinder. The unit is therefore totally enclosed and can be used in a dirty environment.

BRIEF DESCRIPTION OF THE DRAWINGS

The rodless cylinder of this invention will now be described with reference to the attached drawings in which.

DETAILED DESCRIPTION OF THE PREFERRED EMBODIMENT

Figure 1:
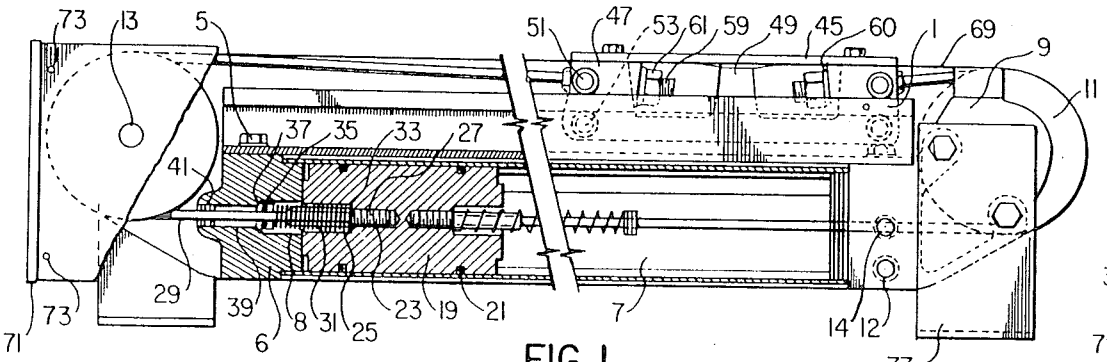
FIG. 1 is a side elevational view of an embodiment of the rodless cylinder of this invention showing part of the internal mechanism.
Figure 2:
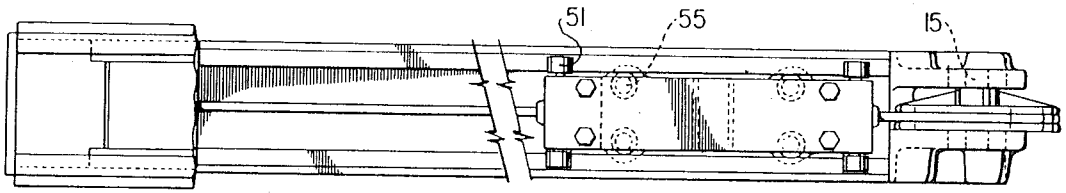
FIG. 2 is a top plan view of the rodless cylinder of FIG. 1.
Figure 3:
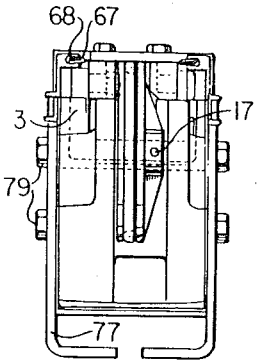
FIG. 3 is a side elevational view of the rodless cylinder of FIG. 1.
Figure 4:
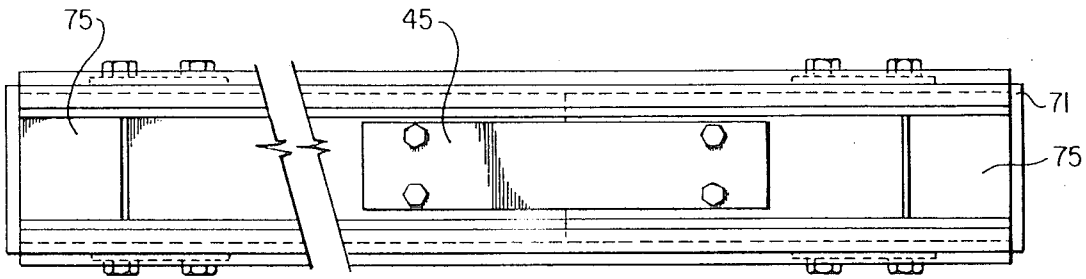
FIG. 4 is a top plan view of the outside of the rodless cylinder of FIG. 1.
Figure 5:
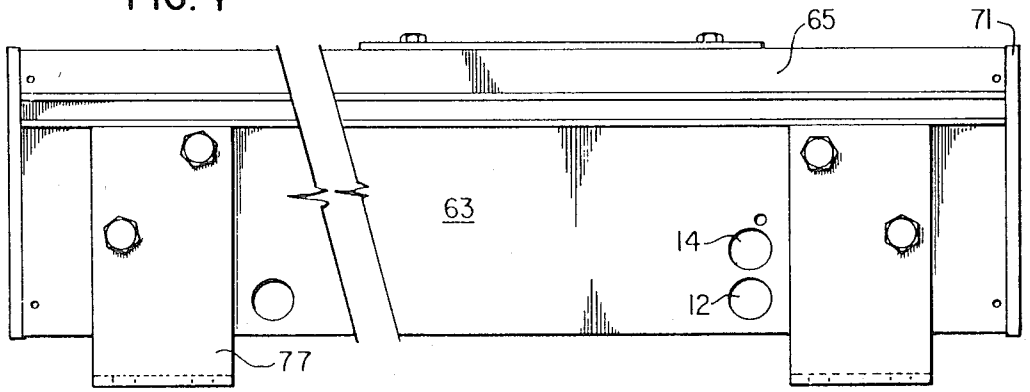
FIG. 5 is a side elevational view of the outside of the rodless cylinder of FIG. 1.
Figure 6:
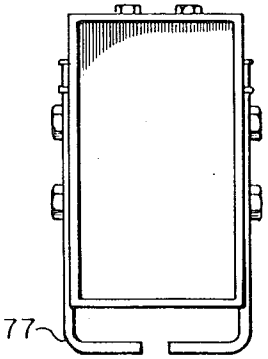
FIG. 6 is a side elevational view of the outside of the rodless cylinder of FIG. 1.
Figure 7:
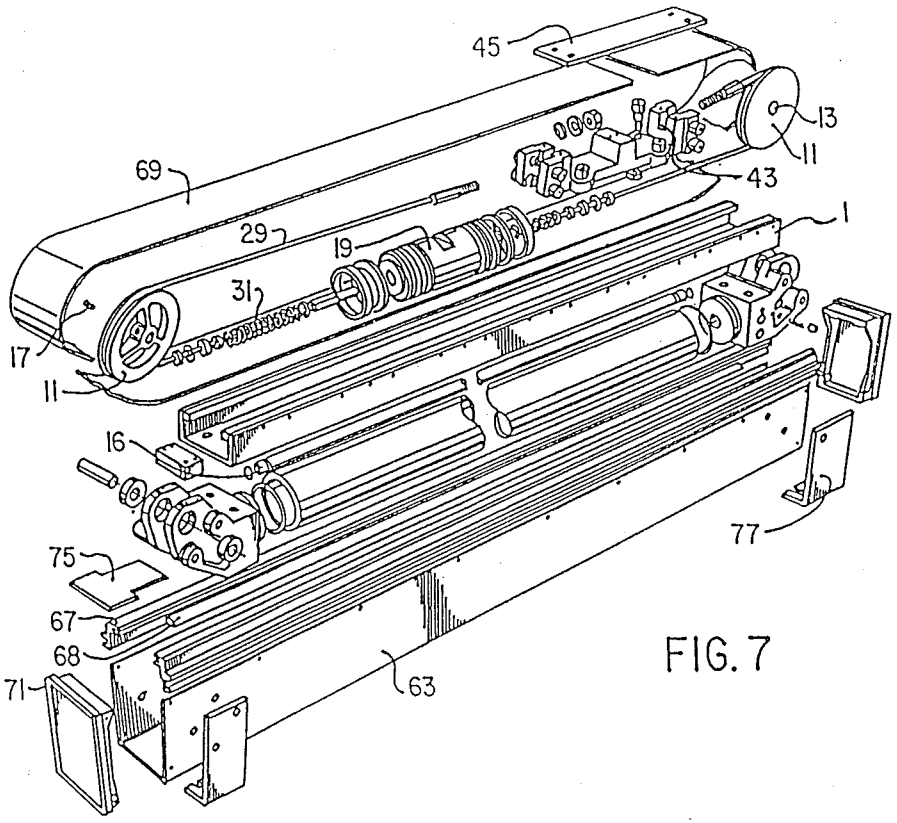
FIG. 7 is an exploded view of the rodless cylinder of FIG. 1.
Figure 8:
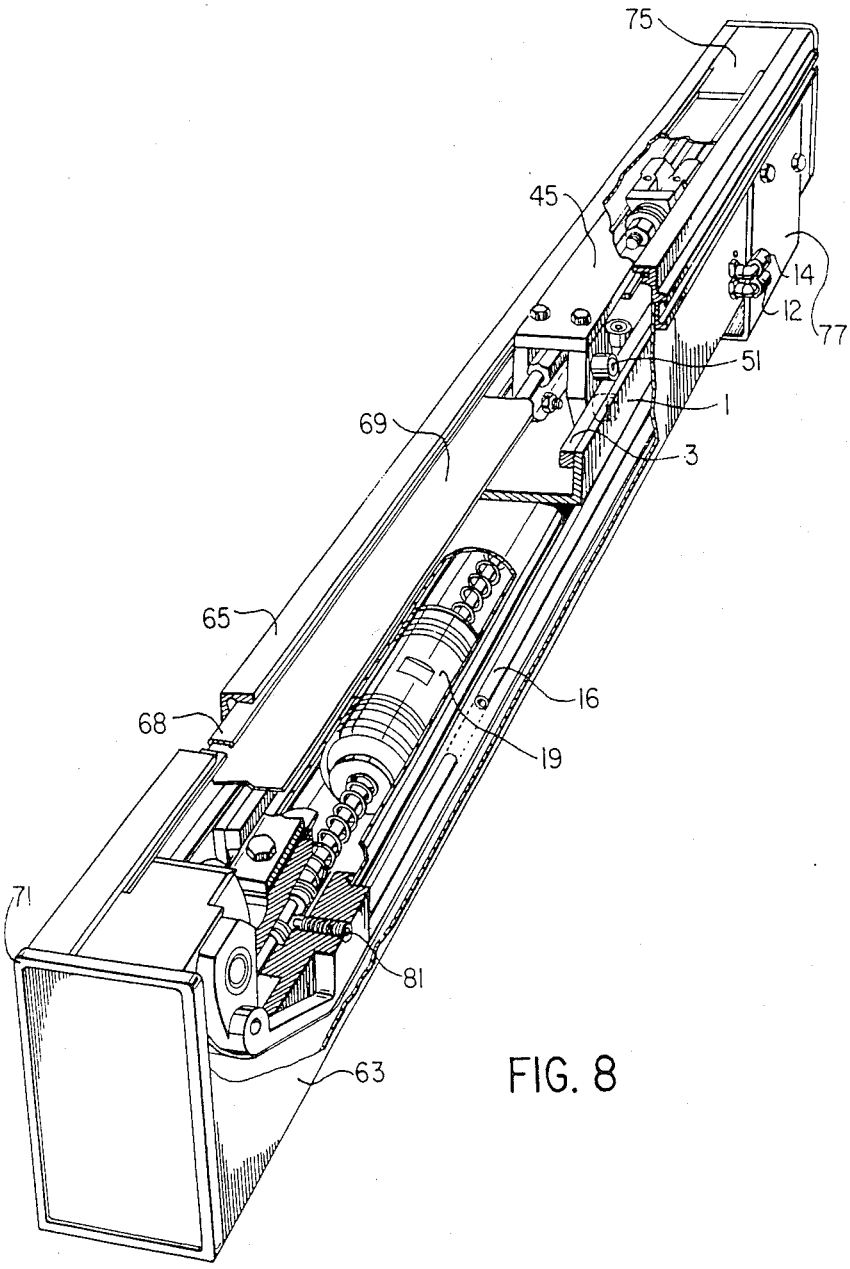
FIG. 8 is a perspective view, partly in section, of the rodless cylinder of FIG. 1.

Referring to the drawings, the rodless cylinder of this invention consists of a channel shaped guide support 1 having tracks or rails 3 secured to the upper ends of the flanges of the channel by countersunk tap bolts or other convenient means (not shown). The channel is bolted by bolts 5 to a cylinder 7 through cylinder ends 6. A pulley 11 is rotatably supported at an extension 9 from each end by a shaft 13 held in conventional bearings 15 (not detailed). Set screw 17 or a roll pin or other securing means is used to attach each pulley to its respective shaft.

A piston 19 is within cylinder 7 and includes conventional piston ring grooves and piston rings shown generally at 21. From each end of the piston 19 there are drilled concentric bores 23 and 25. Into bore 23, which is threaded, there is screwed an end connection 27 to which a cable 29 is firmly secured. The bore 25 includes a compressible resilient member such as a coil spring 31, which acts between the shoulder 33 at the juncture of bores 23 and 25, and an annular disk sealing member 35 which can co-operate with a valve seat 37 in the end cap 6, or with a bore 8 in the end cap and then the valve seat 37, or solely with bore 39 in the end cap. The cable 29 passes through bore 39 and a seal 41 in the end cap 6. The cable 29 passes around pulley 11 and is secured to a drive block system which consists of two integral side end blocks 47 and a centre block 49. The centre block 49 can be dispensed with if required. A top plate 45 is bolted to the blocks. To each end block 47 are secured cam rollers 51, 53 and 55 which preferably utilize needle bearings, to support the drive block assembly for constrained reciprocal movement along the rails 3. Rollers 51 and 55 are preferably eccentrically mounted so that adjustments towards and away from the guides can be made. End blocks 47 have a passage 43 therethrough to accept threaded ends connection 59 on cables 29 which have nuts 61 to provide tensioning adjustment for the cables. Belleville washers 60 are provided below the nuts 61 to accommodate minor changes due to cable stretching. A sheet metal or plastic cover 63 passes around the rodless cylinder ending at each side of the top in a strengthened outer top edge 65 which could conveniently, for example, be an extruded section. This part 65 has inwardly extending grooves 67 with plastic edge seals 68 therein and a flexible plastic or fabric belt 69 extends around both of the pulleys 11, below cylinder 7, and between seals 68, both ends joining and being secured below top plate 45 upon centre block 49. When a centre block is not utilized the belt can be joined below the cylinder by a known type of belt connector, securement of the belt still occurring with the top plate. End caps 71 which can conveniently be cast are secured to each end of the cover 63 by screws 73, and, after the addition of small upper end scraper plates 75 between the ends of grooves 67, the internal mechanism of the rodless cylinder will be completely enclosed. Support brackets 77 are secured by bolts 79 to extensions 9.

During operation of the rodless cylinder, pressurized fluid enters through one of the ports 12, 14, a pipe 16 leading fluid from port 12 to the left hand end cap, passes through bore 39 and forces the piston 19 along the cylinder 7 so moving the drive block mechanism and the belt 69. When the piston has moved a set distance along the cylinder, annular disk seal 35 contacts at least seat 37 and prevents the exit of fluid from the opposite end of the piston. Note that when one port functions as an inlet the other functions as an exhaust. The resilient member 31 is preferably of a length such that fluid is prevented from leaving the cylinder at a location wherein the fluid cushion will be longer than the piston length. Pressure of trapped fluid then begins to build up on the opposite side of the piston and provides a cushion of fluid which smoothly decelerates the piston so preventing excessive shock which would occur upon rapid deceleration. The pressure of the cushion of fluid is permitted to rise to a predetermined level before it is allowed to escape via a pressure relief valve 81. The pressure relief valve 81 is preferably adjustable and also preferably has a leakdown which may be adjustable.

It will thus be seen that a rodless cylinder has been disclosed which is constructed to lessen excessive shock loads upon the cables connecting the piston to the drive block mechanism so that stretching of the cables is minimized and adjustment is rarely required to tension the cables. The rodless cylinder also has a high strength guide channel which is equipped with rigid steel rails and needle bearing cam rollers which provides a degree of drive block load control which is not presently available in this art. The rodless cylinder is also completely enclosed so that it can be used in a dirty environment.

What is claimed and desired to be secured by Letters Patent is:

1. A rodless cylinder, comprising:

a cylinder, a piston within the cylinder for reciprocal movement therein, a guide positioned outside of the cylinder and including a channel-shaped support secured to the cylinder and forming a track along free edges of flanges of the channel-shaped support, a drive block mechanism constrained to move along the guide and including a plurality of rollers to guide the mechanism in a path which is constrained vertically and traversely with respect to the channel-shaped support, a pulley at each end of the cylinder and guide, a cable extending from each end of the cylinder, around one pulley and secured to each end of the drive block mechanism, a compressible resilient member extending from each end of the piston, a sealing member cooperable with a valve seat located within an exit from each end of the cylinder such that when the piston approaches one end of the cylinder, the resilient member forces the sealing member into sealing contact with the valve seat so preventing egress of fluid from one end of the piston to outside of the respective end of the cylinder; and a cover having a top, bottom, sides and ends, the top having a slot for permitting reciprocal movement of the drive block mechanism therein, an inwardly facing groove in the cover and along each side of the slot, and a belt extending below the drive block mechanism, around the pulleys and below the cylinder to completely enclose the cylinder, the guides, the drive block mechanism, the pulleys, the cable, the compressible resilient member, and the sealing member.

2. The cylinder of claim 1 wherein a sidewall portion of a bore within an end cap of the cylinder forms the valve seat.

3. The cylinder of claim 2, wherein the valve seat is formed at intersection of concentric bore portions having differing diameters.

4. The rodless cylinder of claim 1, further comprising:

an adjustable relief valve having a preset leakdown pressure in each end of the cylinder for limiting the level of fluid pressure which is prevented from exiting the cylinder.

5. The cylinder of claim 1, wherein the resilient member extends from each end of the piston for a distance greater than the length of the piston, such that cushioned deceleration of the piston is obtained for a distance greater than the piston length.

6. A rodless cylinder, comprising:

a cylinder having first and second cylinder ends;

a piston reciprocatingly movable within the cylinder;

a guide means affixed to the cylinder and having first and second parallel planar substantially horizontal surfaces and a third planar substantially vertical surface perpendicular to the first and second planar surfaces;

drive block means longitudinally movable along the guide means and having a plurality of first rollers for rolling engagement with the first surface, a plurality of second rollers for rolling engagement with the second surface and a plurality of third rollers for rolling engagement with the third surface, the first, second and third plurality of rollers cooperating with the first, second and third surfaces of the guide means for limiting movement of the drive block means in both a vertical direction and a direction transverse to the longitudinal movement of the drive block means;

first and second pulleys each adjacent a respective first and second cylinder ends;

a cable having a first portion secured to and extending from a first end of the piston, through a bore in the first cylinder end, around the first pulley and to the drive block means, and having a second portion secured to and extending from a second end of the piston, through a bore in the second cylinder end, around the second pulley and to the drive block means;

a valve seat adjacent the bore in the first cylinder end;

sealing means carried by the cable for sealing engagement with the valve seat when the piston approaches the first cylinder end to prevent fluid flow from the first end of the piston through the first bore in the first cylinder end;

compressible resilient means carried by the cable between the first end of the piston and the sealing means for biasing the sealing means toward sealing engagement with the valve seat; and fluid pressure control means at each end of the cylinder for automatically controlling fluid pressure within the cylinder at a preselected value to effect deceleration of piston movement within the cylinder after sealing engagement of the valve seat and sealing means.

7. The rodless cylinder as defined in claim 6, further comprising:

a second valve seat adjacent the second bore in the second cylinder end;

second sealing means carried by the cable for sealingly engaging the second valve seat when the piston approaches the second cylinder end to prevent fluid flow from the second end of the piston through the second bore in the second cylinder end; and second compressible resilient means carried by the cable between the second end of the piston and the second sealing means for biasing the second sealing means into sealing engagement with the second valve seat.

8. A rodless cylinder as defined in claim 6, wherein the resilient means has a length greater than the length of the piston for cushioning deceleration of the piston over a distance greater than the piston length.

9. The rodless cylinder as defined in claim 6, wherein the fluid pressure control means comprises:

a pressure sensitive relief valve at each end of the cylinder for automatically limiting the discharge of fluid for the cylinder and thereby control fluid pressure within the cylinder.

10. The rodless cylinder as defined in claim 9, wherein the pressure-sensitive relief valve means is selectively adjustable to regulate the preselected value of controlled fluid pressure.

11. The rodless cylinder as defined in claim 6, wherein the guide means includes a channel-shaped support secured to the cylinder and defining the first and second planar surfaces.

12. In a rodless cylinder including a cylinder having first and second cylinder ends, a piston reciprocatingly movable within the cylinder, a guide fixed to the cylinder, a drive block longitudinally movable along the guide, first and second pulleys each adjacent the respective first and second cylinder ends, a cable having a first portion secured to and extending from a first end of the piston, through a bore in the first cylinder end, around the first pulley and to the drive block, and having a second portion secured to and extending from a second end of the piston through a bore in the second cylinder end, around the second pulley, and to the drive block, and a valve seat adjacent the bore in the first cylinder, the improvement comprising:

sealing means carried by the cable for sealing engagement with the valve seat when the piston approaches the first cylinder end to prevent the fluid flow from the first end of the piston, through the first bore in the first cylinder end;

pressure sensitive relief valve means at each end of the cylinder for automatically limiting the discharge of fluid from the cylinder to control fluid pressure within the cylinder at a preselected value to control deceleration of piston movement within the cylinder after sealing engagement of the valve seat and sealing means;

said guide comprising first and second parallel planar horizontal surfaces and a third planar vertical surface substantially perpendicular to the first and second planar surfaces; and the drive block including a plurality of first rollers for rolling engagement with the first surface, a plurality of second rollers for rolling engagement with the second surface and a plurality of third rollers for rolling engagement with the third surface for limiting movement of the drive block in a vertical direction and in a horizontal direction transverse to the longitudinal movement of the drive block.

13. The rodless cylinder as defined in claim 12, wherein the guide includes a channel-shaped support secured to the cylinder and defining the first, second and third planar surfaces.

14. A rodless cylinder, comprising:

a cylinder;

a piston within the cylinder for reciprocal movement therein;

a guide positioned outside of the cylinder and including a channel shaped support secured relative to the cylinder and having a guide track provided along free edges of flanges of the channel-shaped support;

a drive block mechanism constrained to move along the guide track and including a plurality of rollers to guide the mechanism in a path which is constrained vertically and transversely with respect to the channel-shaped support;

a pulley at each end of the cylinder and guide;

cables extending from each end of the piston, around each pulley and secured to each end of the drive block mechanism;

sealing means surrounding the cables at each end of the cylinder to prevent the egress of fluid from the cylinder;

a compressible resilient member extending from each end of the piston;

a sealing member cooperable with a vale seat located within an exit from each end of the cylinder such that when the piston approaches one end of the cylinder, the resilient member forces the sealing member into sealing contact with the valve seat so preventing egress of fluid from one end of the piston to outside of the respective end of the cylinder; and a cover having a top, bottom, sides and ends, the top having a slot for permitting reciprocal movement of the drive block mechanism therein, an inwardly facing groove in the cover and along each side of the slot, a belt sized to fit movably within the grooves and extend from beneath the drive block, around the pulleys and below the cylinder, completing the enclosure of the cylinder, the guides, the drive block mechanism, the pulleys, the cable, the compressible resilient member, and the sealing member.

15. The cylinder of claim 14 wherein a sidewall portion of a bore within an end cap of the cylinder forms the valve seat.

* * * * *